US009302364B2

(12) United States Patent
Dovel

(10) Patent No.: US 9,302,364 B2
(45) Date of Patent: Apr. 5, 2016

(54) HAND-HELD TOOL SHARPENER WITH FLEXIBLE ABRASIVE DISK

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 376 days.

(21) Appl. No.: 13/844,788

(22) Filed: Mar. 15, 2013

(65) Prior Publication Data

US 2013/0324014 A1 Dec. 5, 2013

Related U.S. Application Data

(60) Provisional application No. 61/653,870, filed on May 31, 2012.

(51) Int. Cl.
*B24B 3/54* (2006.01)
*B24B 3/36* (2006.01)

(52) U.S. Cl.
CPC ..... *B24B 3/36* (2013.01)

(58) Field of Classification Search
CPC ..... B24B 3/54; B24B 3/36
USPC ..... 451/349, 45
See application file for complete search history.

(56) References Cited

U.S. PATENT DOCUMENTS

| | | | | |
|---|---|---|---|---|
| 2,142,105 | A | | 1/1939 | Blankner |
| 2,522,942 | A | | 9/1950 | Gillen |
| 2,775,075 | A | | 12/1956 | McMaster et al. |
| 2,789,345 | A | | 7/1957 | Spear et al. |
| 2,798,345 | A | * | 7/1957 | Spear et al. ..... 451/415 |
| 2,898,709 | A | | 8/1959 | Bednarski |
| 2,900,768 | A | | 8/1959 | MacFarland |
| 4,333,273 | A | | 6/1982 | Roucau et al. |
| 4,612,731 | A | | 9/1986 | Eckel |
| 4,627,194 | A | | 12/1986 | Friel |
| 4,716,689 | A | | 1/1988 | Friel |
| 4,807,399 | A | | 2/1989 | Friel |
| 4,809,467 | A | * | 3/1989 | De Fazio ..... 451/490 |
| 4,915,709 | A | | 4/1990 | Andrew et al. |
| D328,410 | S | | 8/1992 | Friel |
| 5,148,634 | A | | 9/1992 | Bigliano et al. |
| 6,113,476 | A | | 9/2000 | Friel, Sr. et al. |
| 6,290,582 | B1 | | 9/2001 | Eklund |
| 6,863,600 | B2 | * | 3/2005 | Friel, Sr. ..... 451/293 |
| 6,875,093 | B2 | * | 4/2005 | Friel et al. ..... 451/260 |
| 6,932,683 | B2 | * | 8/2005 | Li ..... 451/193 |
| 7,517,275 | B2 | * | 4/2009 | Friel et al. ..... 451/198 |
| 7,740,522 | B2 | | 6/2010 | Walker |
| 2006/0211345 | A1 | * | 9/2006 | Levsen ..... 451/261 |
| 2009/0081931 | A1 | * | 3/2009 | Levsen ..... 451/262 |

* cited by examiner

*Primary Examiner* — Robert Rose
(74) *Attorney, Agent, or Firm* — Hall Estill Attorneys at Law

(57) ABSTRACT

Apparatus and method for sharpening a cutting tool, such as but not limited to a kitchen knife. In accordance with some embodiments, a flexible abrasive disk is adapted for rotation about a central axis at a selected rotational velocity. Centrifugal forces imparted to the disk during rotation urge the disk to a neutral position in which an outer peripheral portion of the disk is extended toward a selected plane. A housing adjacent the flexible disk has a guide slot with a guide surface at a selected bevel angle with respect to the selected plane. The guide surface is adapted to facilitate presentation of a cutting tool in contacting engagement against the disk. The cutting tool is presented at the selected bevel angle to induce curvilinear displacement of the flexible disk during sharpening of a cutting edge that extends along a side of the cutting tool.

30 Claims, 8 Drawing Sheets

HAND-HELD TOOL SHARPENER WITH FLEXIBLE ABRASIVE DISK

RELATED APPLICATIONS

This application makes a claim of domestic priority to U.S. Provisional Application No. 61/653,870 filed May 31, 2012. The contents of this provisional application are hereby incorporated by reference.

BACKGROUND

Cutting tools such as knives are used in a variety of applications to cut or otherwise remove material from a workpiece. A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use, and thus it can be desirable to subject a dulled cutting tool to a sharpening operation to restore the cutting edge to a greater level of sharpness. A variety of sharpening systems are known in the art, including but not limited to grinding wheels, whet stones, abrasive cloths, abrasive belts and sharpening steels.

SUMMARY

Various embodiments of the present disclosure are generally directed to an apparatus and method for sharpening a cutting tool, such as but not limited to a kitchen knife.

In accordance with some embodiments, a flexible abrasive disk is adapted for rotation about a central axis at a selected rotational velocity. Centrifugal forces imparted to the disk during rotation urge the disk to a neutral position in which an outer peripheral portion of the disk is extended toward a selected plane. A housing adjacent the flexible disk has a guide slot with a guide surface at a selected bevel angle with respect to the selected plane. The guide surface is adapted to facilitate presentation of a cutting tool in contacting engagement against the disk. The cutting tool is presented at the selected bevel angle to induce curvilinear displacement of the flexible disk during sharpening of a cutting edge that extends along a side of the cutting tool.

These and other features and advantages of various embodiments can be understood with a review of the following detailed description and the accompanying drawings.

DETAILED DESCRIPTION

The present disclosure is generally directed to an apparatus and method for sharpening a cutting tool. As explained below, in some embodiments the apparatus comprises at least one flexible abrasive disc adapted for rotation at a selected rotational velocity about a central axis. Centrifugal force imparted to the disk urges the disk to a neutral position in which a distal circumferential perimeter of the disc is urged toward alignment with a selected plane orthogonal to the central axis.

A housing encloses the disc and has a guide slot with a guide surface aligned along selected bevel and skew angles. The guide surface is adapted to facilitate presentation of a side of a blade of the cutting tool in contacting engagement against the disk at said bevel and skew angles to induce curvilinear displacement of the flexible disc out of the neutral position during a sharpening operation. The innermost perimeter of the disc remains at a fixed position while a portion of the outermost perimeter of the disc is curvilinearly displaced.

Multi-stage sharpening can be performed with different discs having different characteristics such as different levels of abrasiveness and/or flexibility. This can provide a multi-faceted convex grinding geometry to the cutting tool. The sharpening apparatus may be characterized as a hand-held, portable and electrically powered sharpener.

Figure 1:
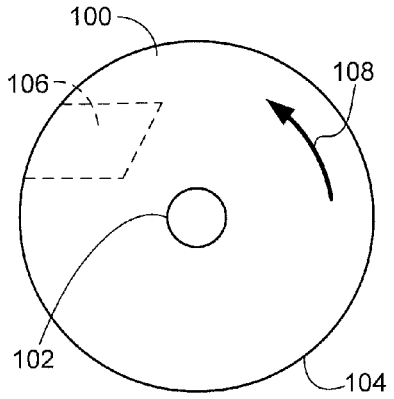
FIG. 1 shows a plan view of a rotatable flexible abrasive disc used to sharpen a cutting tool in accordance with some embodiments.

These and other features of various embodiments can be understood beginning with a review of FIG. 1 which depicts a flexible (floppy) abrasive disk 100. The disk 100 is circular in shape with an interior sidewall 102 defining a central aperture to facilitate attachment of the disk 100 to a shaft. An outer sidewall 104 defines an outermost peripherally extending edge of the disk 100.

A sharpening zone is denoted at 106, which generally represents an area against which a cutting tool may be applied to carry out a sharpening operation thereon as the disk is rotated in direction 108. Other locations on the disk surface for the sharpening zone, and other directions of rotation, can be used.

The term "sharpening" and the like will describe an operation carried out to increase a sharpness level of a cutting edge of a tool to improve efficiency of a cutting operation in which a workpiece is penetrated, eroded and/or divided by the tool. Such sharpening may include the removal of material from the tool and/or the alignment of existing material along the cutting edge of the tool. The term "grinding" is encompassed within the meaning of sharpening but is generally directed to the removal of significant amounts of material from the tool.

The term "honing" is also encompassed with the meaning of sharpening but is generally directed to the alignment of material without significant amounts of material removal.

Figure 2A:
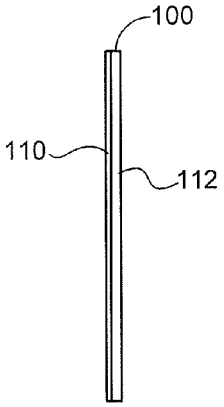
FIGS. 2A and 2B illustrate single-sided and double-sided abrasive versions of the disc of FIG. 1.
Figure 2B:
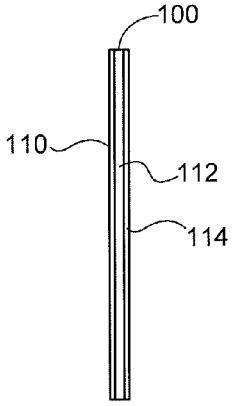

FIGS. 2A-2B illustrate various possible constructions for the disk 100. FIG. 2A provides a single-sided abrasive construction with a single abrasive layer 110 affixed to a backing layer 112. FIG. 2B incorporates a second abrasive layer 114 opposite the first layer 110. The respective physical properties of the layers, such as thickness, stiffness, abrasiveness, etc. can vary depending on the requirements of a given application, so long as the disk 100 is sufficiently flexible to be elastically deformed during operation as described herein. In some embodiments, the abrasive layer(s) may take the general form of sandpaper, diamond overcoat, a matrix file pattern, etc. with a random or regular abrasive media pattern. The backing layer 112 may be cloth, paper, thin metal, or some other construction. In some embodiments, no separate backing layer is used.

Figure 3A:
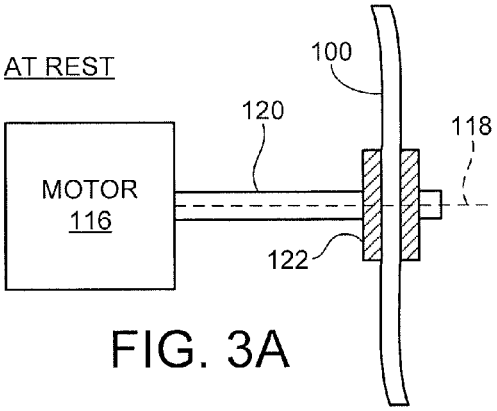
FIG. 3A shows the disc of FIG. 1 coupled to a motor for rotation, the disc in FIG. 3A being at rest.
Figure 3B:
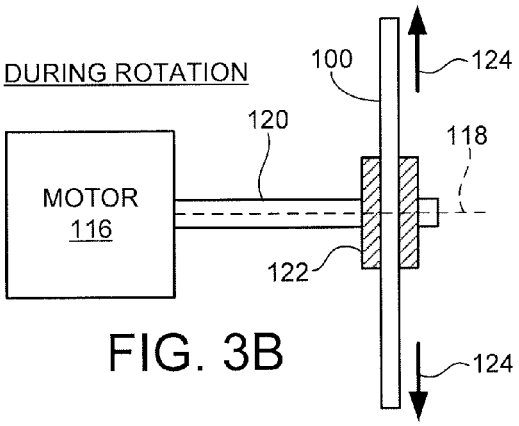
FIG. 3B shows the arrangement of FIG. 3A during rotation at a selected rotational velocity which urges the disc to a neutral position.

FIGS. 3A and 3B depict a portion of a sharpening system that incorporates the disk 100 of FIG. 1 in accordance with some embodiments. An electrically powered motor 116 is adapted to rotate the disk 100 about a central axis 118 via an elongated shaft 120. FIG. 3A shows the disk 100 at rest, and FIG. 3B shows the disk 100 during rotation.

The shaft 120 has a diameter sized to closely fit within the central aperture of the disk, and the disk is secured to the shaft via a hub 122. Other disk attachment arrangements can be used, including multiple spaced apart discs and multiple hubs, clamping systems that clamp the disc with a smaller (or no) central aperture extending through the disk, etc.

The attachment mechanism, in this case the hub 122, maintains the innermost periphery of the disk 100 in a fixed position along the shaft 120 (e.g., a selected distance from the motor 116) both while at rest and during rotation.

The flexible nature of the disk 100 may allow the disk to deform under the weight thereof into a non-planar orientation while the disk is at rest, as depicted in FIG. 3A. Centrifugal forces denoted by arrows 124 tend to urge the disk 100 to a neutral position during rotation as depicted in FIG. 3B, so that outer portions of the disk are extended away from the center of rotation. The neutral position in FIG. 3B is substantially planar along a plane orthogonal to the central axis 118. Alternative neutral positions are discussed below, including non-planar neutral positions. The term "neutral position" denotes a nominal configuration taken by the disk during rotation prior to contact with a cutting tool. It will be understood that some positional variations, oscillations, etc. may be encountered by the disk in the neutral position.

Presentation of a cutting tool for sharpening against the disk 100 during rotation induces localized curvilinear displacement of the disk out of the neutral position. The type and extent of curvilinear displacement can vary depending on a variety of factors including presentation angle, surface pressure, angular and radial location of the sharpening zone (106, FIG. 1), and stiffness of the disk.

Figure 4A:
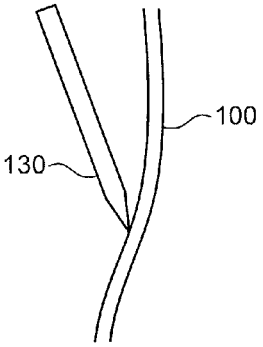
FIGS. 4A-4D are schematic representations of various curvilinear deflection responses of the disc in FIG. 3B in response to presentation of a cutting tool for sharpening.
Figure 4B:
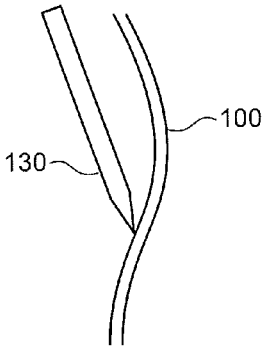
Figure 4C:
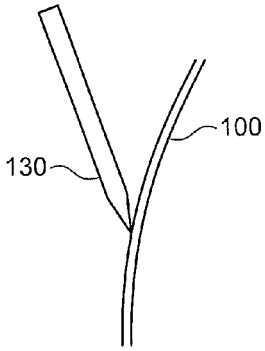
Figure 4D:
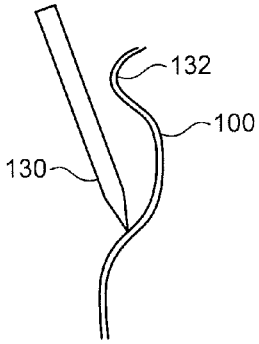

FIGS. 4A-4D illustrate different types of localized disc displacement that may occur during presentation of a cutting tool 130 for sharpening. FIGS. 4A-4B generally denote an S-shaped deformation, FIG. 4C generally denotes a C-shaped deformation, and FIG. 4D generally denotes a W-shaped deformation with a separate standing wave portion 132 near the outermost periphery of the disk. Other types of curvilinear deformation of the flexible disk are envisioned during a sharpening operation. Localized compression of the disk (e.g., localized narrowing of the thickness of the disk) may also occur in addition to the curvilinear deformation induced by presentation of the cutting tool 130.

Figure 5A:
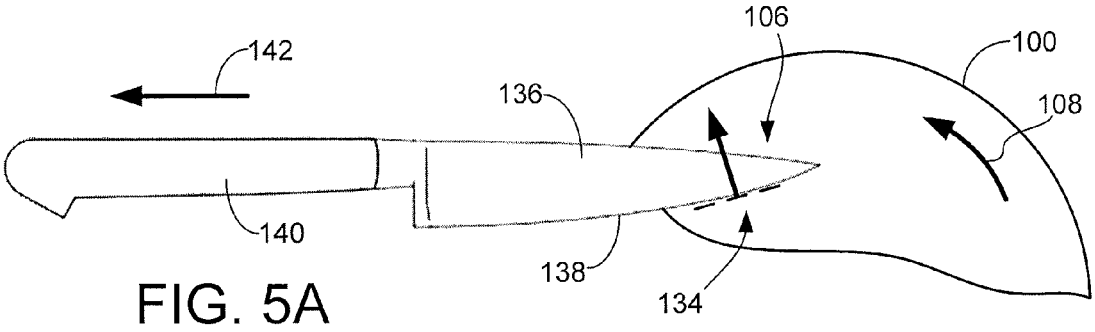
FIGS. 5A-5C illustrate presentation of the cutting tool of FIGS. 4A-4D in greater detail.
Figure 5B:
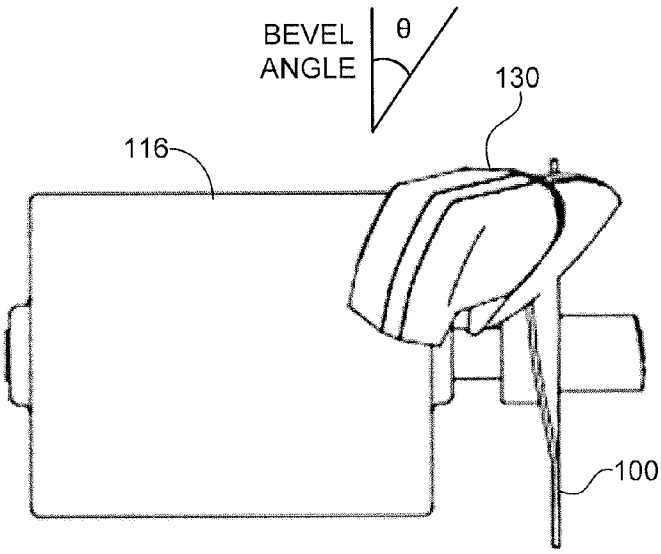
Figure 5C:
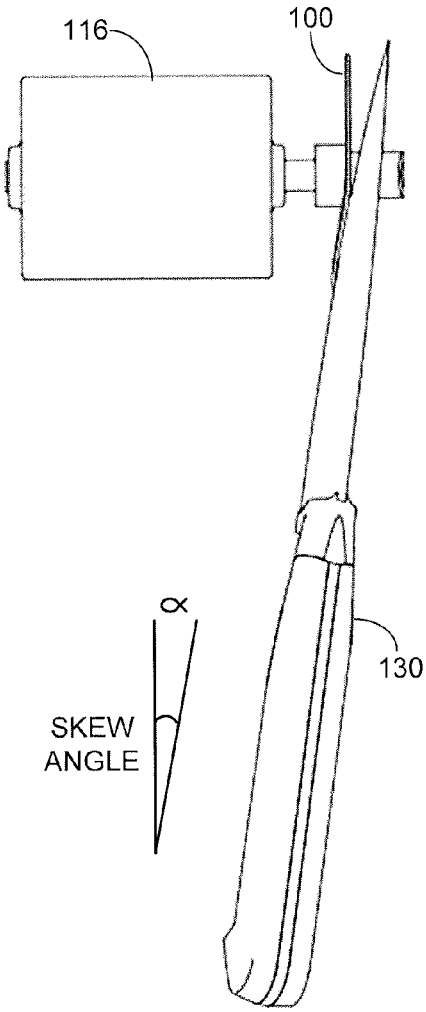

FIGS. 5A-5C show the cutting tool 130 of FIGS. 4A-4D in greater detail. The tool 130, characterized as a kitchen knife, is applied against the sharpening zone 106 (FIG. 1) of the disk 100 during a sharpening operation, causing the disk 100 to deflect from a point of contact 134 out to the outer peripheral edge 104 of the disk.

As further shown in FIGS. 5B and 5C, the deflection is generally induced as a result of contact with the side of a blade 136 of the tool 130, as a localized portion of the disc "bends" around the distal end of the blade 136 adjacent a cutting edge 138 thereof. The deflection may further be generally induced in terms of a localized "twist" of the disk in relation to the curvature of the cutting edge 138. The deflection may vary as the user grasps a handle 140 of the knife 130 and draws the blade 136 across the disk 100 in general direction 142 and different portions of the curvilinearly extending edge 138 is presented to the disk. The user may draw the handle 140 back in a straight motion, or pull up slightly on the handle as the knife 130 is withdrawn to account for curvilinear variations of the cutting edge along the length of the blade.

A guide surface (not separately shown in FIGS. 5A-5C) facilitates presentation of the disk 100 along two non-orthogonal angles with respect to a vertical plane passing through the central axis 118: a bevel angle $\theta$ as shown in FIG. 5B, and a skew angle $\alpha$ as shown in FIG. 5C.

The bevel angle $\theta$ represents a rotation of the knife along a length thereof so that the cutting edge 138 is canted toward the disk abrasive surface during sharpening. Suitable bevel angles may include angles in the range of about 20-25 degrees, and angles greater than or less than this range. In some cases, bevel angles of 45 degrees or greater may be used.

The skew angle $\alpha$ represents a rotation of the knife about a center point passing through the center of gravity of the knife, so that the tip of the blade 136 is pointed away slightly from the plane of the disk 100. Suitable skew angles may include angles in the range of about 5-10 degrees, and other angles greater or less than this range.

Figure 6A:
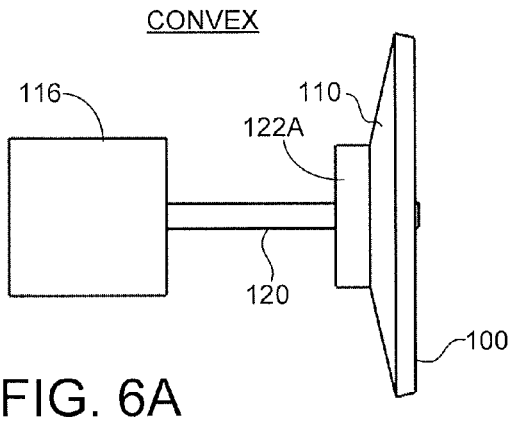
FIGS. 6A-6C provide an alternative arrangement to that shown in FIGS. 3A-3B in which the disc is cupped to provide a nominally convex abrasive surface.
Figure 6B:
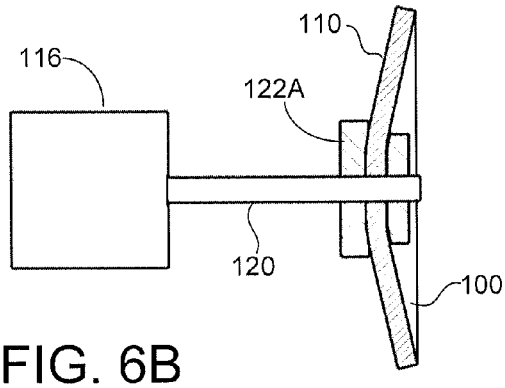
Figure 6C:
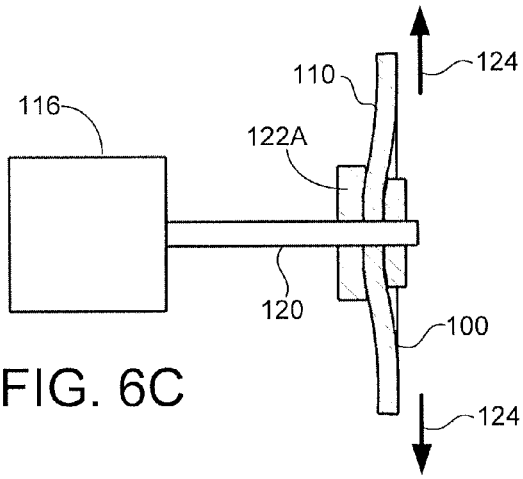

FIGS. 6A-6C illustrate an alternative configuration for the sharpener that imparts a convex sharpening surface 110 to the flexible disc 100 using a specially adapted hub 122A. FIGS. 6A-6B show the disk 100 at rest, and FIG. 6C shows the disk during rotation. In this context, the term "convex" relates to the overall shape of the abrasive surface 110 against which the knife 130 is applied. The disk 100 may be initially flat as in FIG. 1 prior to installation of the disk into the hub 122A, or the disk may be initially cupped with either a convex or concave shape prior to installation.

Rotation of the convex flexible disk 100 induces centrifugal forces 124 which place the disk 100 into a neutral position, illustrated in FIG. 6C. In this case, the neutral position largely remains convex, but an outermost periphery of the disk 100 is nevertheless urged toward a substantially planar orientation; in this way, the forces 124 tend to "flatten" the disk at the outermost extremity thereof. The disk 100 is curvilinearly deflected from this neutral position responsive to contact by the knife 130 as generally discussed above. The convex shape imparted by the hub 122A may reduce the surface pressure along the cutting edge 138 of the knife 130 as compared to the planar orientation of FIGS. 3A-3B.

Figure 7A:
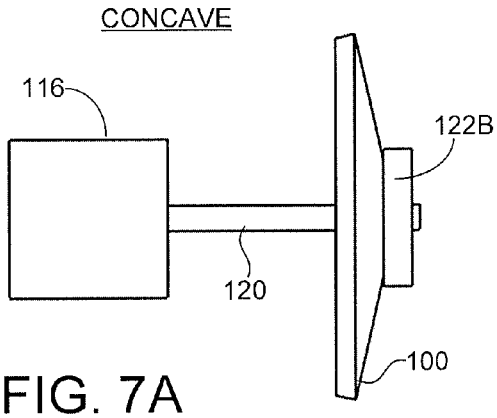
FIGS. 7A-7C provide another alternative arrangement to that shown in FIGS. 3A-3B in which the disc is cupped to provide a nominally concave abrasive surface.
Figure 7B:
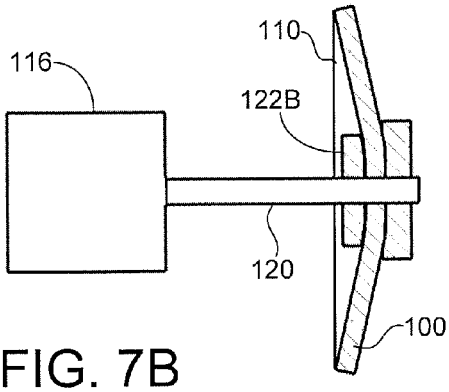
Figure 7C:
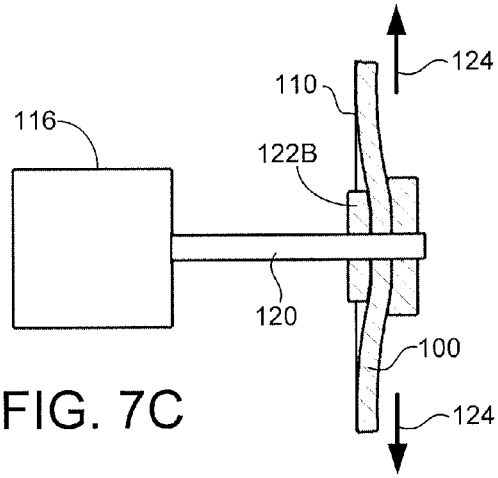

FIGS. 7A-7C provide yet another alternative embodiment in which a hub 122B imparts a concave shape to the disk 100. The term "concave" is described in relation to the shape of the abrasive surface 110 against which the knife blade is applied. As before, the disk 100 may be initially flat, or may be provided with an initial non-planar shape. FIGS. 7A and 7B show the disk 100 at rest, and FIG. 7C shows the disk during rotation. Centrifugal forces 124 tend to flatten the disk 100 during rotation so that the outermost periphery toward a substantially planar orientation.

Figure 8:
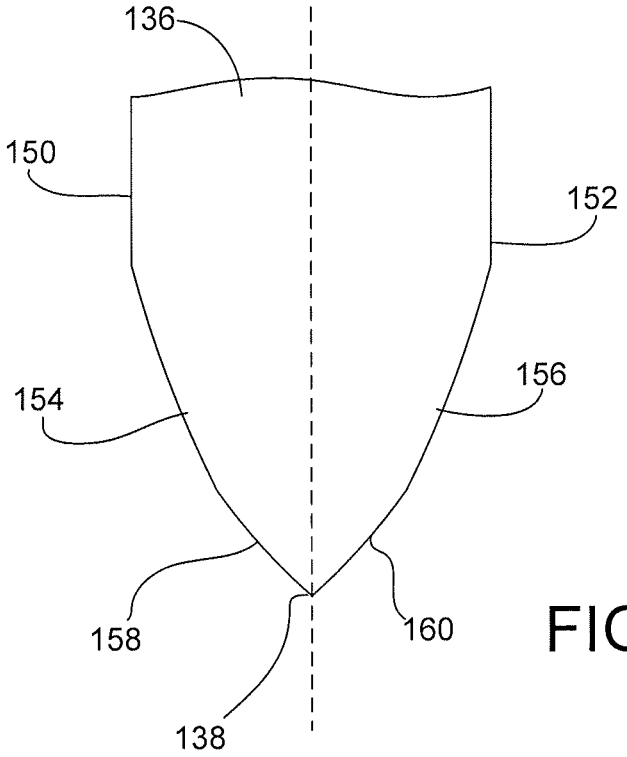
FIG. 8 shows the cutting tool of FIGS. 5A-5C with a multi-faceted convex surface sharpening geometry.

FIG. 8 shows a multi-faceted convex sharpening geometry that can be applied to the knife blade 136. The blade includes opposing planar side walls 150, 152 which extend substantially the entire height of the blade. Each side of the blade 136 further has a first curvilinearly extending, convex bevel surface 154, 156, and a second curvilinearly extending, convex bevel surface 158, 160. The second bevel curves converge to form the cutting edge 138.

Figure 9A:
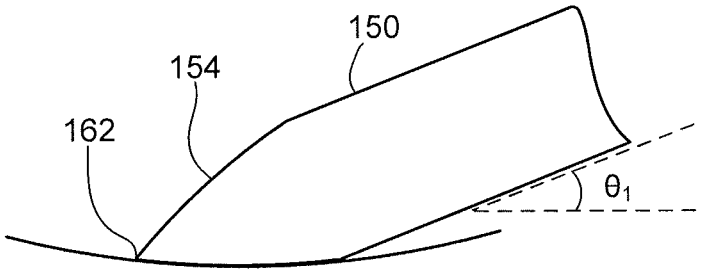
FIGS. 9A-9B respectively illustrate first and second sharpening stages used to form the geometry of FIG. 8.
Figure 9B:
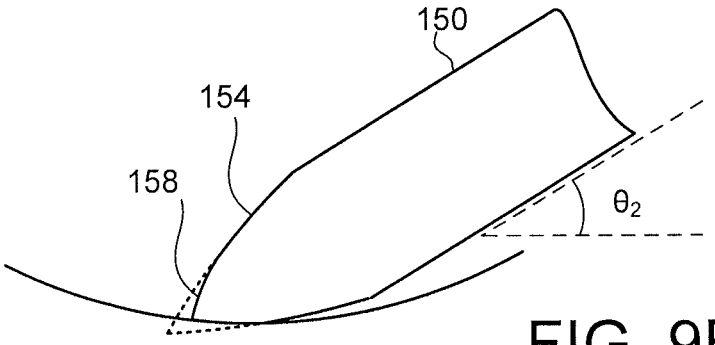

The respective first and second bevel surfaces are formed using a two-stage sharpening process. A first stage is represented in FIG. 9A, and a second stage is represented in FIG. 9B. In the first stage sharpening operation of FIG. 9A, the knife blade 136 is applied against a first disk surface 110A with a first set of disk characteristics, such as a first flexibility level, a first abrasiveness level, a first diameter, a first speed, etc.

A first bevel angle $\theta_1$, such as about 20 degrees, is used to present the blade 136 against the first disk surface. A corresponding first skew angle can also be used, but such is not depicted in FIG. 9A. Both sides of the blade 136 are subjected to the first-stage processing of FIG. 9A, either using the same disk surface 110A or using different surfaces on the same or separate disks. The processing of FIG. 9A forms the bevel surfaces 154, 156 with a first radius of curvature. The bevel surfaces 154, 156 are longer than in FIG. 8, and may extend all the way to the end of the blade and converge to a first cutting edge 162.

FIG. 9B illustrates the second-stage sharpening process, during which the blade 136 is subsequently presented against a second abrasive disk surface 110B after the processing of FIG. 9A. The second surface 110B has a second set of disk characteristics that may be the same as, or differ from, the characteristics of the first surface 110A. A different bevel angle $\theta_2$, in this case about 25 degrees, is shown although this is merely illustrative and not limiting as the same bevel angles (and the same skew angles) can be used.

The second-stage processing of FIG. 9B forms the second bevel surfaces 158, 160. This removes some of the material at the distal end of the blade, including the first cutting edge 162 to form the second cutting edge 138. The second bevel surfaces 158, 160 have a second radius of curvature greater than the first radius of curvature of the first bevel surfaces 154, 156. This enhances both the sharpness and the durability of the finished cutting edge 138.

In some embodiments, only a single faceted sharpening operation may be applied to the knife so that the cutting edge takes the general form in FIG. 9A. In other embodiments, a greater number of stages of sharpening can be applied to provide each side of the blade with three or more facets, each with a different radius of curvature.

Multi-stage sharpening arrangements can be used so that respective grinding (material removal) and honing (material alignment) operations are carried out upon the tool at different stages. It will be appreciated that the extent to which a given disk grinds or hones a tool depends on a number of factors including presentation geometry, disk stiffness, disk abrasiveness, surface pressure, tool geometry, tool composition, etc.

Figure 10A:
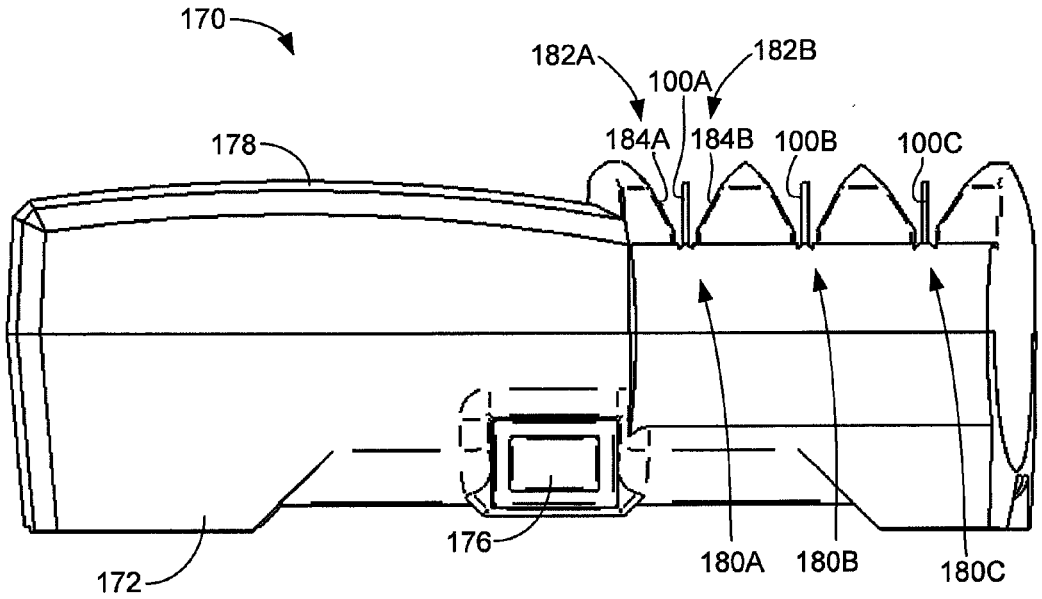
FIGS. 10A-10B depict multi-stage sharpener that utilizes a number of flexible discs.
Figure 10B:
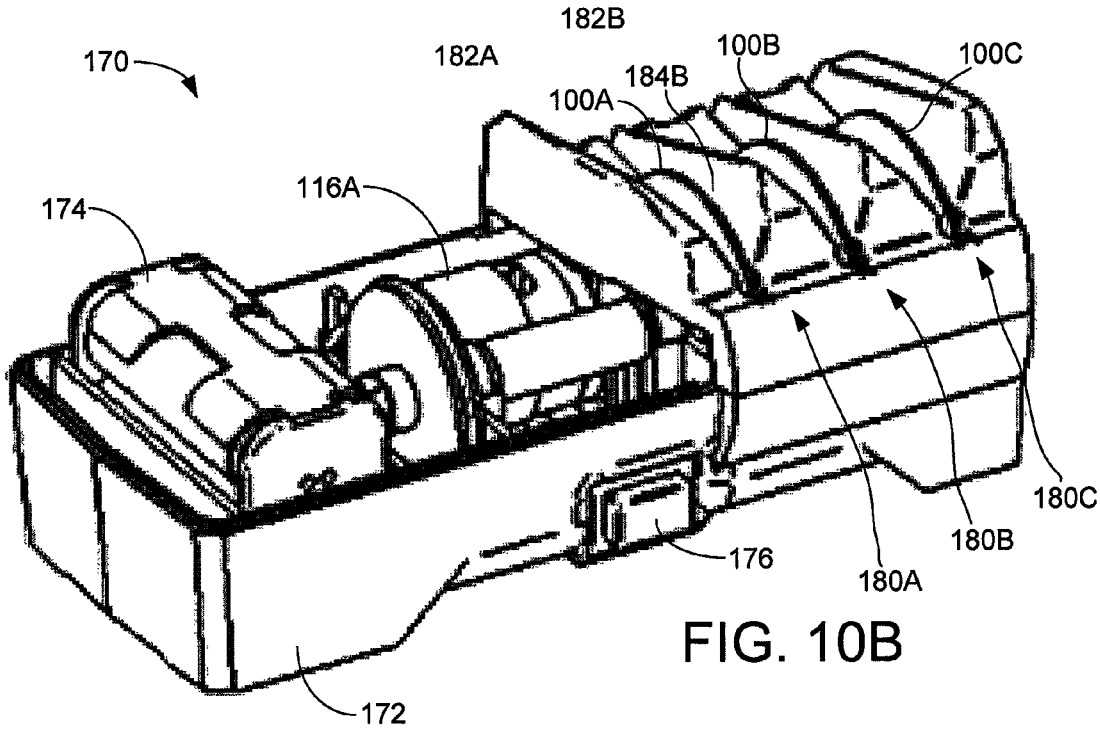

FIGS. 10A-10B show a tool sharpener 170 in accordance with some embodiments. The tool sharpener 170 is characterized as a portable electric three-stage sharpener that utilizes three flexible, double-sided abrasive disks 100A-C (see e.g. FIG. 2B). The sharpener 170 may be placed on a suitable support surface, such as a kitchen counter, during use.

A housing 172 encloses the disks 100A-C as well as other components such as a motor 116A and a battery power pack 174. The battery power pack may use rechargeable batteries which can be recharged using a separate power plug (not shown) that can be plugged in to supply power from a domestic electric grid. A user activated switch 176 initiates operation of the motor and rotation of the disks. A removable cover 178 provides access to the interior of the housing 172.

Three respective sharpening stages are denoted at 180A-C. Each stage includes one of the disks 100A-C as well as a pair of opposing guide slots 182A-B with associated guide surfaces 184A-B to provide each stage with associated bevel and skew angles.

To sharpen a cutting tool such as the knife 130, the user sequentially subjects the knife 130 to each of the sharpening stages 180A-C in turn. In some sharpening sequences, less than all of the stages may be used.

Beginning with stage 180A, the user grasps the knife by the handle 140, inserts the blade 136 into the first guide slot 182A so as to contactingly engage the associated guide surface 184A, and draws the knife back against the associated disk 100A while maintaining the side of the blade against the guide surface. The user may repeat this a number of times, such as 3-5 times. This will sharpen a first side of the blade 136 to form a first curvilinear bevel, as generally depicted in FIG. 9A.

The user next repeats the process using the second guide slot 182B of the first stage 180A. The knife may be inserted from the same side as with guide slot 182A, or may be inserted from the opposing side of the housing 172. As before, the knife blade is contactingly aligned against the guide surface 184B and drawn back across the disk 100A. It will be noted that the knife is sharpened against opposing sides of the same disk 100A during the first stage sharpening.

At the conclusion of the first stage sharpening, the blade will generally have opposing elongated curvilinear bevels as generally depicted in FIG. 9A. The user then proceeds with further sharpening in a similar fashion using the second and third stages 180B and 180C.

Figure 11A:
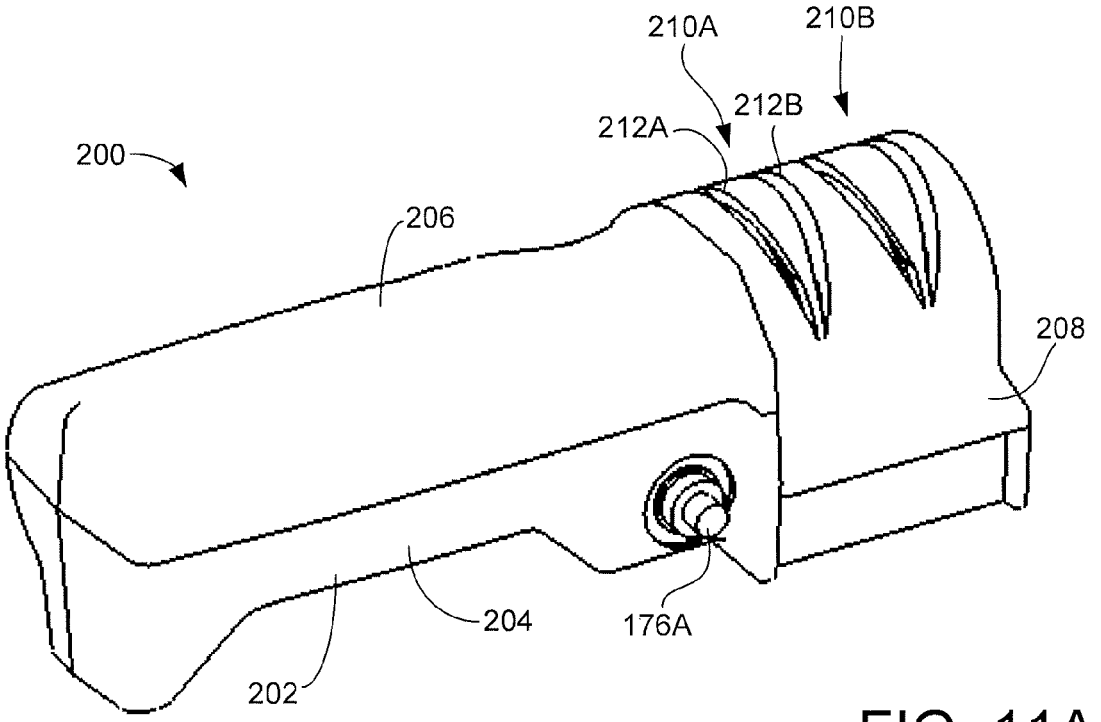
FIGS. 11A-11B depict another multi-stage sharpener similar to that of FIGS. 10A-10B.
Figure 11B:
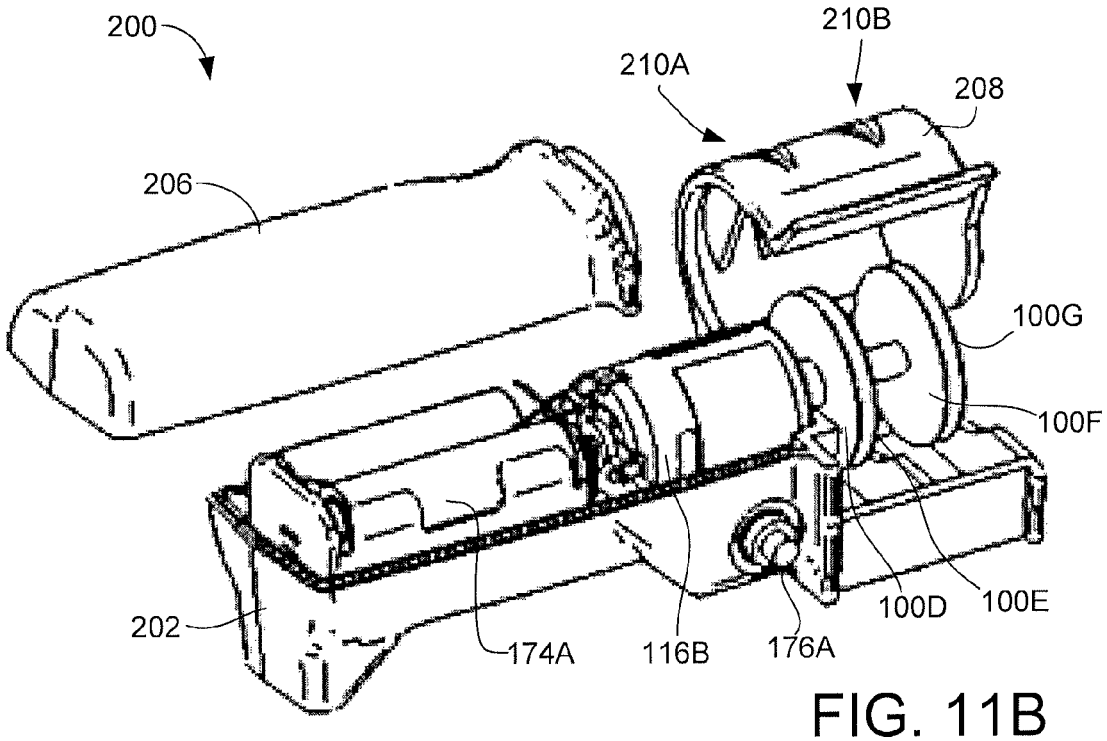

FIGS. 11A-11B illustrate another sharpener 200 constructed and operated in accordance with some embodiments. The sharpener 200 is generally similar to the sharpener 170, and may be characterized as a hand held two-stage four disk sharpener. While the sharpener 200 can be placed upon a support surface during sharpening, the sharpener 200 may alternatively be held in the user's hand as desired.

The sharpener 200 includes a housing 202 which encloses a motor 116B and a power pack 174A. A user activated switch 176A activates the motor to rotate disks 100D-G. The disks in FIGS. 11A-11B may be characterized as single-sided flexible abrasive disks as generally depicted in FIG. 2A. A user grip surface 204 enables a user to grasp the housing 202 with the left and engage the switch 176A using the left thumb while holding and manipulating the knife 130 in the right hand. A removable cover 206 provides access to the interior of the housing 202, and a flip-top cover 208 provides access to the disks 100D-G.

The housing 200 includes first and second sharpening stages 210A-210B. Each stage has a pair of guide slots 212A-B and with associated guide surfaces (not separately designated). As before, a cutting tool such as the knife 130 can be sharpened against the associated disks by inserting the tool into the respective slots of the respective stages in turn.

Figure 12A:
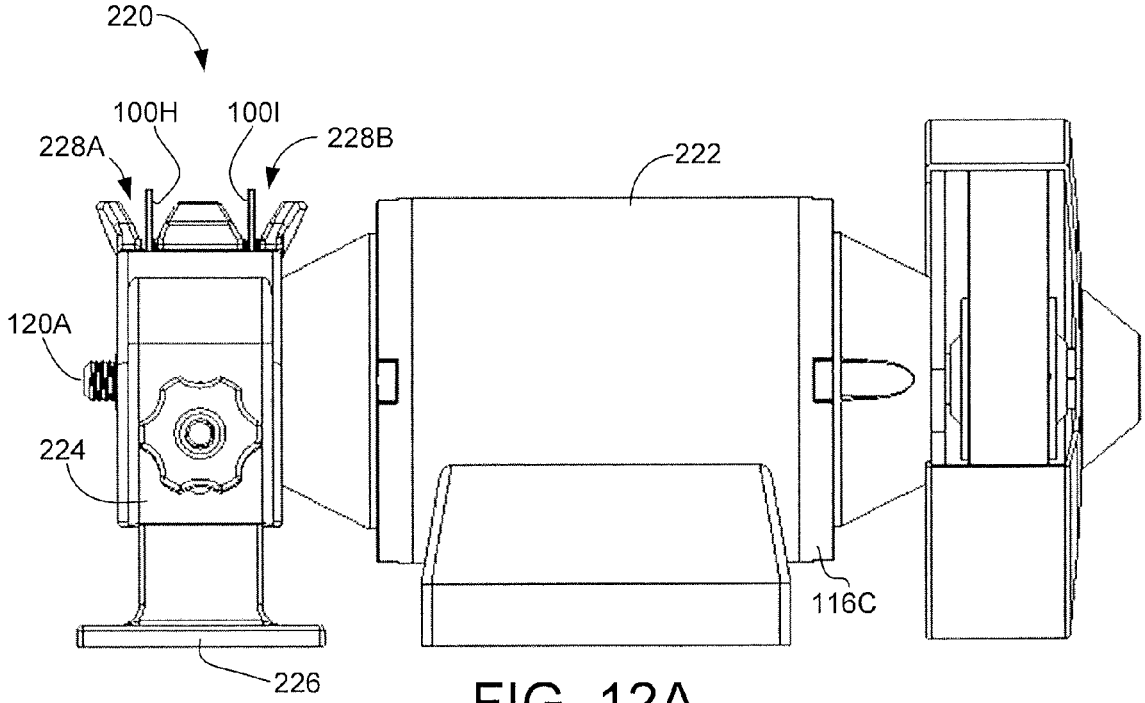
FIGS. 12A-12B depicts yet another multi-stage sharpener similar to that of FIGS. 10A-10B.
Figure 12B:
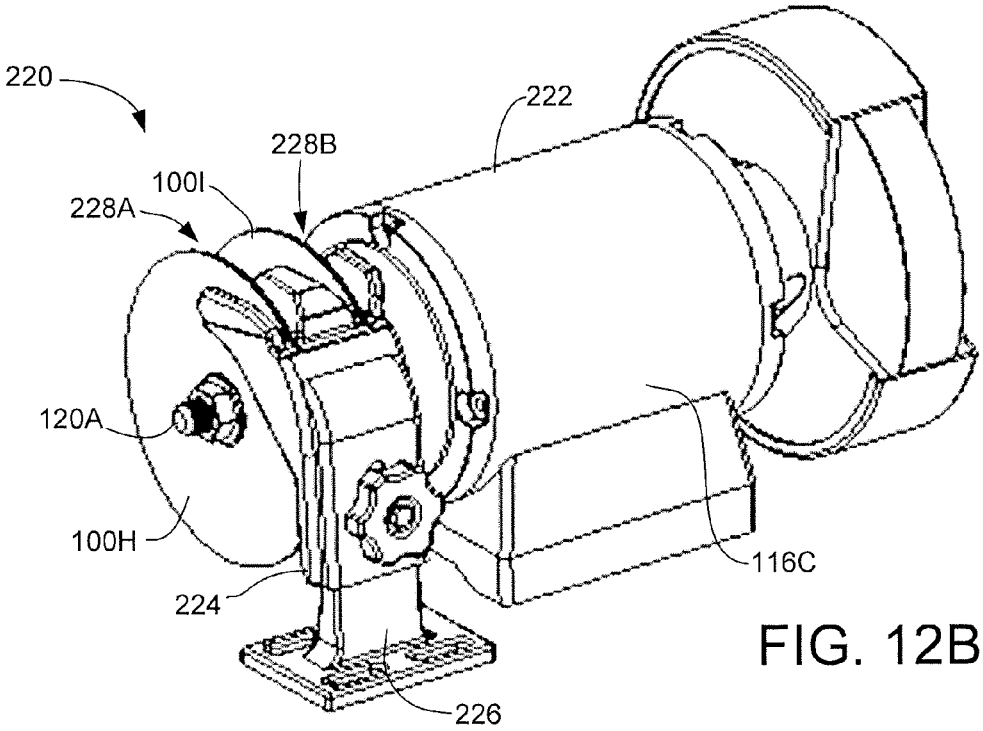

FIGS. 12A-12B illustrate yet another sharpener 220 in accordance with some embodiments. The sharpener is characterized as a sharpening attachment adapted to be coupled to an existing rotary tool, such as tool 222 to provide power to rotate flexible abrasive disks 100H-I. A variety of tools can be used, including but not limited to a hand-held electric drill.

A housing 224 supports the disks with an adjustable height support member 226 and includes first and second stage sharpening ports 228A-B with respective guide slots and associated guide surfaces (not separately designated). A suitable coupling mechanism is used to couple a shaft 120A to the tool to enable a motor of the tool 116C to rotate the discs 100H, 1001 at a selected rotational velocity. The knife 130 or other tool is sharpened using the respective stages 228A-B as described above.

Figure 13A:
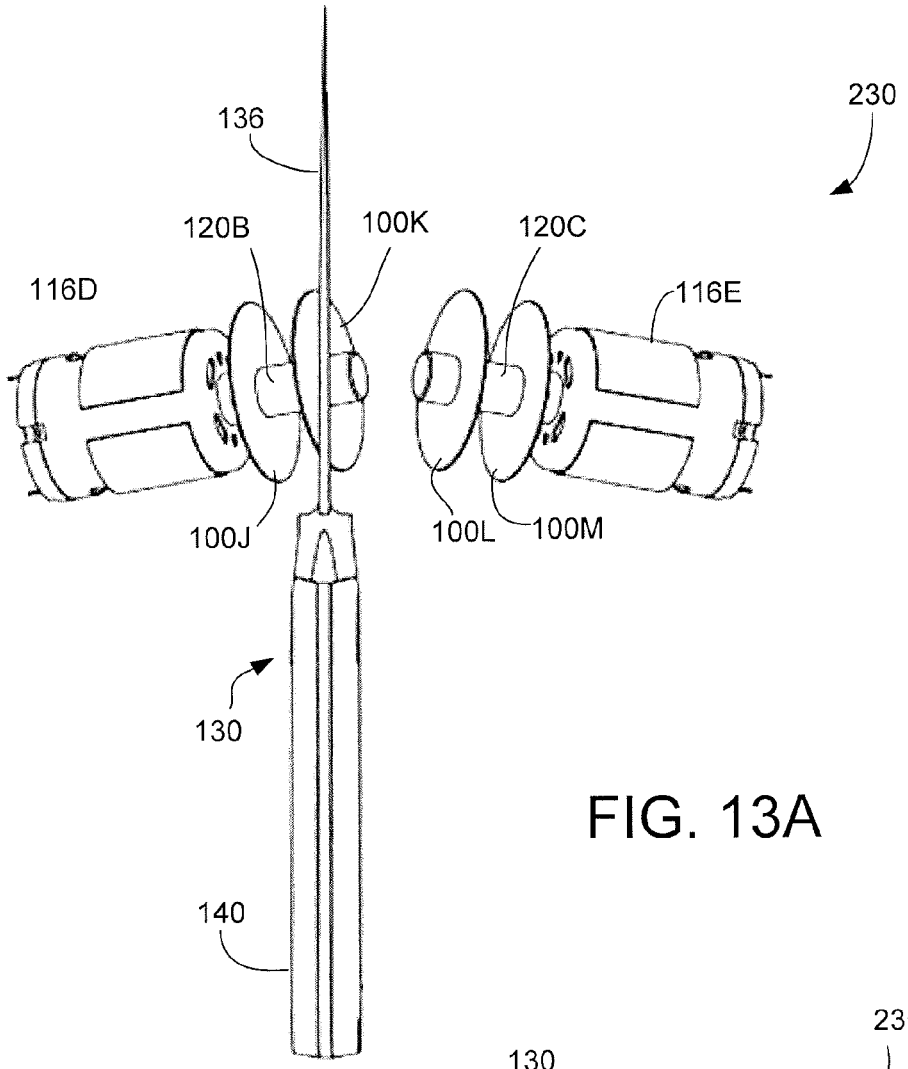
FIGS. 13A-13B depict still another multi-stage sharpener arrangement with canted flexible discs.
Figure 13B:
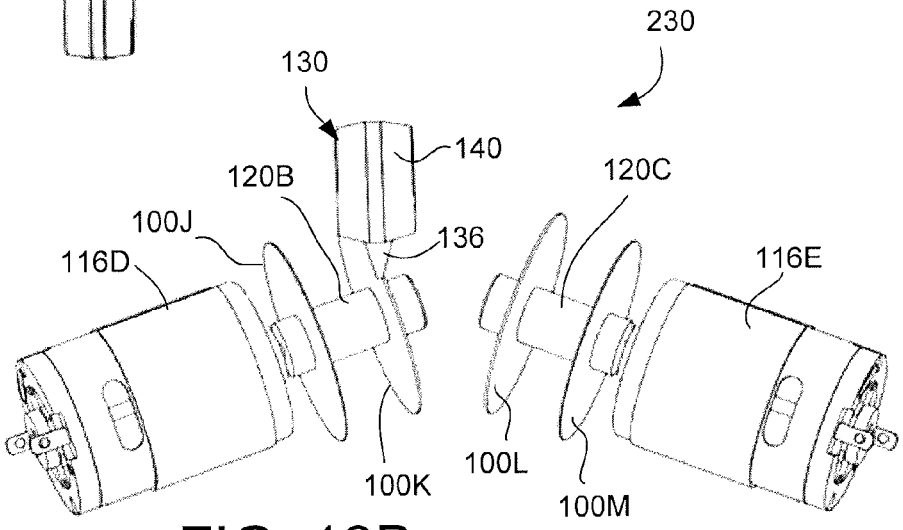

FIGS. 13A-13B set forth another arrangement for a disc sharpener 230 in accordance with some embodiments. The arrangement uses canted motors 116D-E, shafts 120B-C and disks 100J-M to enable presentation of the knife 130 (or other tool) in a substantially vertical orientation to respective sharpening stages. The term "canted" refers to respective skew angles between the axes of rotation of the respective disks 100J-M and an intersecting line that passes through the centers of gravity of the respective shafts 120B-C (or other symmetric reference points).

The blade 136 is at selected bevel and skew angles relative to the disks as before, but these angles are accommodated by displacement of the respective disks within a housing (not separately shown). An advantage of the arrangement of FIGS. 13A-13B is the relative ease with which the user can insert and draw the knife 130 through the respective stages, since in this arrangement the knife is maintained in a substantially vertical orientation during the sharpening process.

As variously embodied, the sharpener of the present disclosure may be characterized without limitation as including elements such as a flexible disk coupled to a motor driven shaft and a guide surface which orients a blade of a cutting tool in a desired position as the blade is presented against the flexible, rotating disk. The disk and guide are configured in a manner such that as the blade is placed and advanced along the guide surface, the blade contacts an abrasive surface of the disk to deform the disk out of a neutral position otherwise occupied by the disk during rotation.

The disk and the associated support structure can be constructed such that the resilience of the disk and/or the forces of rotation acting upon the disk tend to maintain the disk in the neutral position. The local deformation of the disk induced by contacting engagement with the blade provides a controlled sharpening geometry, facilitating grinding and/or honing of the blade. The guide surface is configured such that the blade is presented to the disk at a desired bevel angle and deforms the disk to the desired displacement. The guide may be further configured to skew the blade at a second angle so that the blade only contacts the disk on a selected side, such as on the side of the facing surface of the disk nearest the user.

The disclosed sharpener as embodied herein may provide a number of benefits. It has been found that sharpeners configured as embodied herein can achieve relatively high levels of operational efficiency as compared to current generation sharpeners, and can sharpen standard sized blades using as little as around six watts (6 W) of electrical power. The flexible and thin nature of the disk(s) means that power is not unnecessarily wasted turning heavy wheels, larger armatures or extra gears and bearings.

The sharpeners configured as embodied herein have been found to safely sharpen at speeds higher than current generation sharpeners. In many cases, no cooling mechanisms are required for speeds up to around 5,000 surface feet/minute (SFM). By contrast, many current generation sharpeners tend to require cooling at speeds or around 2,000 SFM or less.

Because of the flexible nature of the disks, each disk type can be individually tailored to provide its own optimal surface pressures, neutral position characteristics and sharpening geometries versus abrasiveness. No separate springs, bias members or other adjustment mechanisms are required.

Many different sharpening applications can be accommodated simply by changing disk(s). Disks can be configured to sharpen highly curved blades (bellies, hooks, recurves, etc.) blades with straight profiles (e.g., scissors, cleavers, etc.), blades with serrations, etc.

The high efficiency design of the sharpeners as embodied herein provide a compact, low power consumption and portable sharpening solution. Multiple stages of sharpening can be offered without the need for multiple guides, spring/disk combinations, etc. Because of their collapsible nature, extra and alternate disks can be easily stored in a small compartment within the sharpener housing.

Because the disk flexibility largely controls the applied surface pressure, a significant amount of compliance can be provided. The angle guide positions the blade relative to the disk while the disk flexes to conform to the blade profile. This provides a fault tolerant and highly repeatable sharpening operation that requires relatively little skill by the user.

Various additional alternatives and configurations will readily occur to the skilled artisan after reviewing the present disclosure, and all such alternatives and configurations are encompassed by the present application and the following claims.

What is claimed is:

1. An apparatus for sharpening a cutting tool, comprising:

a flexible abrasive disk adapted for rotation about a central axis at a selected rotational velocity, wherein centrifugal forces imparted to the disk during said rotation urge the disk to a neutral position in which an outer peripheral portion of the disk is extended toward a selected plane, the flexible disk comprising a flexible backing layer, a first abrasive layer on a first side of the flexible backing layer, and a second abrasive layer affixed to the flexible backing layer on an opposing second side thereof; and a housing adjacent the flexible disk having a guide slot with a guide surface at a selected bevel angle with respect to the selected plane, the bevel angle non-orthogonal to the central axis, the guide surface adapted to contactingly engage a side of the cutting tool to facilitate presentation of the side of the cutting tool in contacting engagement against the disk at the bevel angle to induce curvilinear displacement of the flexible disk during sharpening of a cutting edge that extends along the side of the cutting tool.

2. The apparatus of claim 1, in which the disk is displaced in a first direction away from the central axis responsive to a radius of curvature of the side of the cutting tool and is concurrently displaced in a different, second direction away from the central axis responsive to a profile of a cutting edge of the tool.

3. The apparatus of claim 1, in which the bevel angle is in a range of about 20-25 degrees with respect to the selected plane and represents a rotation of the cutting tool along a longitudinal length thereof so that the cutting edge is canted toward the flexible disk during sharpening thereagainst.

4. The apparatus of claim 1, in which flexible backing layer is a layer of cloth.

5. The apparatus of claim 1, in which the guide surface is further configured to impart a selected skew angle to the cutting tool in a range of about 5-10 degrees and represents a rotation of the cutting tool about a center point passing through the center of gravity of the knife so that a distal tip of the cutting tool is pointed away slightly from the selected plane during sharpening thereagainst.

6. The apparatus of claim 1, in which the housing further comprises a second guide surface at a second skew angle to facilitate presentation of a second side of the cutting tool against the second abrasive layer.

7. The apparatus of claim 1, further comprising a motor enclosed within the housing adapted to rotate the flexible disk at the selected rotational velocity, the motor coupled to the flexible disk via a shaft aligned along the central axis.

8. The apparatus of claim 1, in which the flexible disk is characterized as a first flexible disk and the selected plane is characterized as a first plane, the apparatus further comprising a second flexible disk adjacent to and in spaced apart relation with the first abrasive disk for common rotation therewith at the selected rotational velocity, wherein centrifugal force induced by the rotation of the second flexible disk induces the second flexible disk to nominally extend along a second plane parallel to the first plane.

9. The apparatus of claim 8, in which the first disk has a first abrasiveness level and the second disk has a different second abrasiveness level.

10. The apparatus of claim 8, in which the guide slot is characterized as a first guide slot, and the housing further comprises a second guide slot having a second guide surface at second bevel angle with respect to the to facilitate presentation of a second side of the cutting tool against the second abrasive layer.

11. The apparatus of claim 10, in which the respective bevel angles of the first guide slot and the second guide slot facilitate presentation of the cutting tool at different angles against the respective first and second disks.

12. The apparatus of claim 1, in which the guide surface further imparts a selected skew angle to the cutting tool to direct a distal end of the tool away from the flexible disk, the skew angle non-orthogonal to the selected plane.

13. An apparatus for sharpening a cutting tool, comprising:

a motor;

a flexible disk coupled to the motor for rotation about a central axis at a selected rotational velocity, wherein centrifugal force imparted to the disk urges an outer peripheral portion of the disk to nominally lie along a selected plane during said rotation; and a housing which encloses the motor and the flexible disk, the housing having an outer grip surface to accommodate gripping of the housing by a first hand of a user, the housing further having a guide slot with a guide surface at a selected skew angle with respect to the selected plane non-orthogonal to the central axis, the guide surface adapted to facilitate, via the user grasping the handle of the cutting tool with a second hand of the user, presentation of a first side of the blade of the cutting tool in contacting engagement against the guide surface at said skew angle to induce curvilinear displacement of the flexible disk out of the selected plane by contacting engagement of a cutting edge that extends along the blade against the flexible disk, the guide slot configured such that the skew angle directs a distal end of the cutting tool opposite the handle to point in a direction away from the selected plane and the cutting tool only contacts a single abrasive surface during said sharpening.

14. The apparatus of claim 13, in which the flexible disk has a central aperture with an innermost diameter that engages a shaft assembly coupled to the motor and an outermost annular edge with an outermost diameter, wherein the central aperture and the outermost annular edge are in planar alignment along the selected plane prior to contacting engagement with the cutting tool.

15. The apparatus of claim 14, in which the central aperture of the flexible disk remains in a fixed distance from the motor in planar alignment along the selected plane both prior to and during engagement with the cutting tool.

16. The apparatus of claim 13, in which the disk is displaced into an s-shaped cross sectional shape by said contacting engagement with the cutting tool.

17. The apparatus of claim 13, in which the disk is displaced in a first direction away from the central axis responsive to a radius of curvature of the side of the cutting tool and is concurrently displaced in a different, second direction away from the central axis responsive to a profile of a cutting edge of the tool.

18. The apparatus of claim 13, in which the housing further comprises a second guide surface at a second skew angle.

19. The apparatus of claim 18, in which the first and second skew angles are equal.

20. The apparatus of claim 13, wherein the flexible disk comprises a flexible backing layer, a first abrasive layer on a first side of the flexible backing layer, and a second abrasive layer affixed to the flexible backing layer on an opposing second side thereof.

21. The apparatus of claim 18, in which the flexible disk is characterized as a first flexible disk and the apparatus further comprises a second flexible disk enclosed within the housing and coupled to the motor for rotation at said selected rotational velocity, wherein presentation of the side of the blade in contacting engagement against the second guide surface facilitates contacting engagement of the cutting edge against the second flexible disk at a second skew angle to deform the second flexible disk out of a second plane parallel to the selected plane of the first flexible disk.

22. The apparatus of claim 18, in which the first disk has a first abrasiveness level and the second disk has a different second abrasiveness level.

23. The apparatus of claim 13, further comprising a battery enclosed within the housing to supply electrical power to the motor.

24. The apparatus of claim 13, wherein the disk further undergoes localized compression at a point of contact with the blade.

25. A method for sharpening a cutting tool, comprising:

rotating a flexible abrasive disk about a central axis at a selected rotational velocity to impart centrifugal forces to the disk so as to urge the disk to a neutral position in which an outer peripheral portion of the disk is extended toward a selected plane; and inserting the cutting tool into a guide slot in a housing adjacent the disk so that a side of the cutting tool contactingly engages a guide surface at a selected bevel angle with respect to the selected plane, the selected bevel angle non-orthogonal to the central axis, the side of the cutting tool further contactingly engaging the disk at the selected bevel angle to induce curvilinear displacement of the flexible disk during sharpening of a cutting edge that extends along said side of the cutting tool, the cutting edge contacting only a single abrasive surface during said sharpening.

26. The method of claim 25, in which the disk is displaced from the neutral position into an s-shaped cross sectional shape during the inserting step.

27. The method of claim 25, in which the disk is displaced in a first direction away from the central axis responsive to a radius of curvature of the side of the cutting tool and is concurrently displaced in a different, second direction away from the central axis responsive to a profile of a cutting edge of the tool.

28. The method of claim 25, in which the housing comprises a second guide surface at a second selected bevel angle and the method further comprises repeating the inserting step using the second guide slot.

29. The method of claim 25, in which the guide surface further imparts a selected skew angle to the cutting tool to direct a distal end of the tool away from the flexible disk during the inserting step, the selected skew angle non-orthogonal to the central axis and in a range of from about 10-15 degrees with respect to the selected plane.

30. The method of claim 25, in which the flexible disk comprises a layer of adhesive bonded to a flexible cloth backing layer.

* * * * *